United States Patent [19]

Huang

[11] Patent Number: 5,042,813

[45] Date of Patent: Aug. 27, 1991

[54] INDOOR GOLF TRAINING COURSE

[76] Inventor: Kuo-Shyang Huang, No. 115, Pu-Tzu Li,, Pu-Tzu Hsiang, Taichung, Taiwan

[21] Appl. No.: 480,305

[22] Filed: Feb. 15, 1990

[51] Int. Cl.[5] ..... A63B 67/02

[52] U.S. Cl. ..... 273/182 R

[58] Field of Search ..... 273/176 R, 176 B, 176 F, 273/176 FA, 176 FB, 176 H, 181 A, 181 F, 182 R, 182 A

[56] References Cited

U.S. PATENT DOCUMENTS

| | | | |
|---|---|---|---|
| 1,012,820 | 12/1911 | Cory | 273/176 F |
| 1,785,150 | 12/1930 | Soubier | 273/176 F |
| 4,336,939 | 6/1982 | Krumlauf | 273/176 FB |
| 4,596,391 | 6/1986 | Carolan, Jr. | 273/176 B |
| 4,750,744 | 6/1988 | Michalec | 273/181 A |

*Primary Examiner*—Edward M. Coven
*Assistant Examiner*—William E. Stoll
*Attorney, Agent, or Firm*—Asian Pacific International Patent and Trademark Office

[57] ABSTRACT

A knockdown indoor golf training course, which includes a teeing ground unit having a ball return gutter for guiding a golf ball back to a ball chamber and an elongated strip mechanism for guiding a golf ball to roll down to the ball chamber through the ball return gutter, and a counting net unit foldably mounted on the back side of the teeing ground unit to incorporate with a nested holder through several wire channels which extend from the various holes made on the net for counting the score and identifying the hole on the net a golf ball is driven in.

3 Claims, 3 Drawing Sheets

INDOOR GOLF TRAINING COURSE

BACKGROUND OF THE INVENTION

The present invention relates to a design of built-up type indoor golf course for training purpose.

Because of economical and industrial prosperities, people's livelihood has been greatly promoted and improved. After having been in the enjoyment of good supply, people are more and more concerning about one's health and recreational life. For enjoying good health, one must have to take exercise regularly. Among the various sports, golf is a game most invited by businessmen and those noble men. However, golf is an outdoor game which requires a big area of field to play. It is therefore an idea of the present invention to provide an indoor golf course for training purposes.

SUMMARY OF THE INVENTION

An object of the present invention is to provide an indoor golf training course which includes a golf ball auto-return structure and in which a sloping ball return gutter is made at one lateral side communicating with a target hole via a bevel groove, and the board where such a target hole is made is comprised of two pivoted decks permitting the upper deck to be liftable to guide golf ball to roll down to the ball return gutter.

Another object of the present invention is to provide an indoor golf training course which includes a counting net unit which comprises a net having thereon several holes respectively in communication with the partitions of a nested holder through corresponding wire channels so that the hole on the net to which a golf ball is driven in can be identified and indicated electronically through a display.

Still another object of the present invention is to provide an indoor golf training course which is easy to assemble through tenon-and-groove joint, and can be conveniently detached for packing to minimize space occupation during transportation.

BRIEF DESCRIPTION OF THE DRAWINGS

A more detailed schematic explanation of the invention with reference to the drawings is given by way of example below. However, it is to be understood that the drawings hereunder are designed for purposes of illustration only, and are not intended as a definition of the limits and scope of the invention disclosed.

DETAILED DESCRIPTION OF THE PREFERRED EMBODIMENTS

Figures 1, 1A:
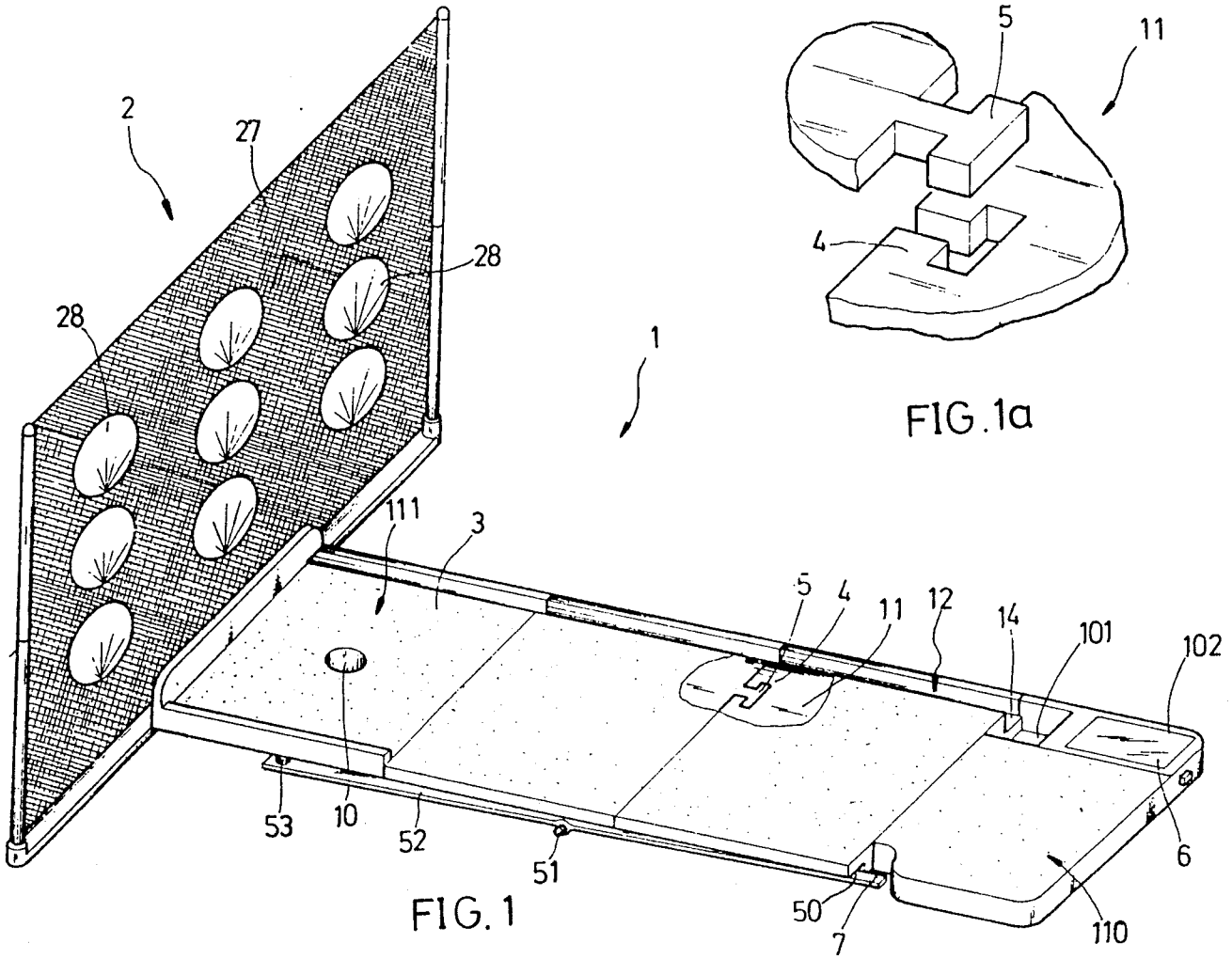
FIG. 1 is a perspective view of an indoor golf training course embodying the present invention.
FIG. 1*a* is a partly enlarged view taken on part 11 of FIG. 1.
Figure 2:
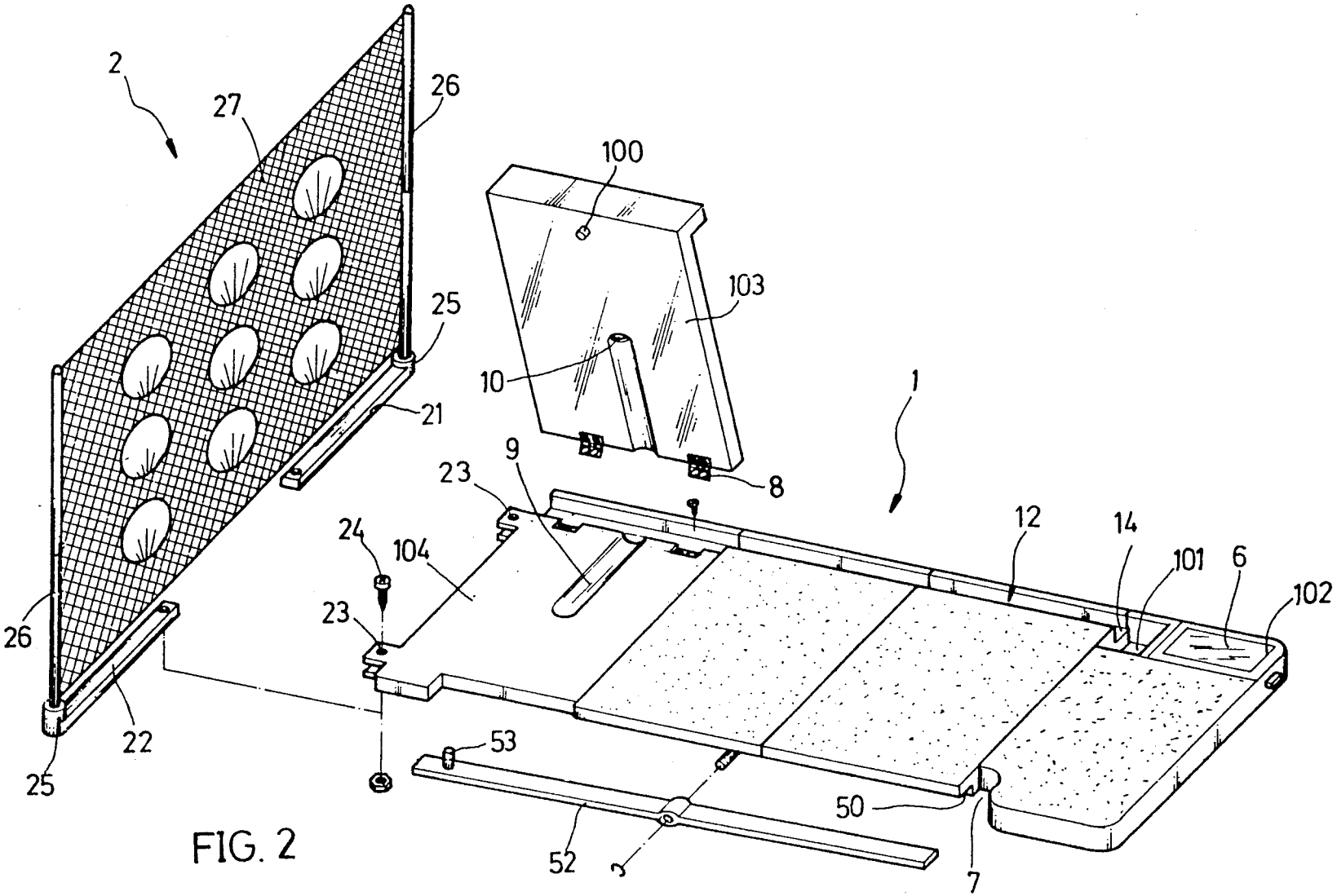
FIG. 2 is a fragmentary perspective view of the embodiment of FIG. 1.
Figures 3, 3A:
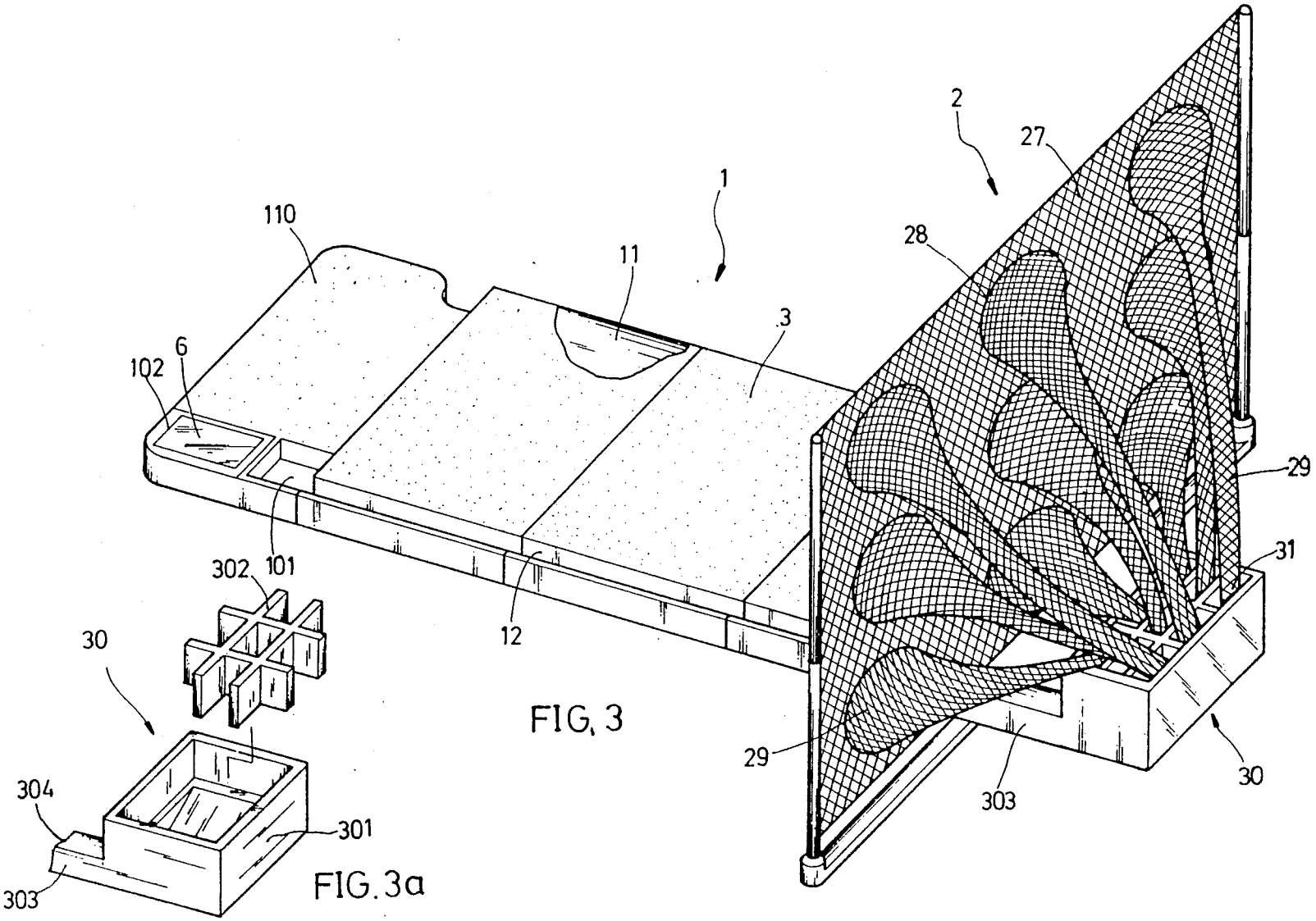
FIG. 3 is a fragmentary perspective back view of the embodiment of FIG. 1.
FIG. 3*a* is a partly enlarged view taken on part 30 of FIG. 3.

Referring to FIGS. 1 through 3, a golf training course in accordance with the present invention is generally comprised of a teeing ground unit 1 and a counting net unit 2. The teeing ground unit 1 is comprised of a plurality of flat boards including a front end board 110, a rear end board 111 and a plurality of intermediate boards 11, which are covered with a layer of velvet or the like and respectively connected by means of T-tenons 5 and T-grooves 4 to provide a flat surface serving as a teeing ground, wherein the intermediate boards 11 and the rear end board 111 have each a side groove 14 aligned with one another in a line to form a ball return gutter 12. The front end board 110 comprises a ball chamber 101 on its one side adjacent to the intermediate boards 11, a recess hole 102 on the ball chamber 101 at a rear end for receiving a display 6, and a notch 7 on its another side opposite to the ball chamber 101. The rear end board 111 is comprised of an upper board 103 laterally pivotably connected with a bottom board 104 by means of hinges 8, wherein the upper board 103 comprises a mounting slot 100 at a side and a round hole 10 in the center, and the bottom board 104 comprises a bevel groove 9 extending laterally from its center point to communicate with the ball return gutter 12 such that a ball which enters the round hole 10 of the upper board 103 can run through the bevel groove 9 and the ball return gutter 12 to the ball chamber 101. The teeing ground unit 1 comprises a setback portion 50 on the intermediate boards 11 and part of the rear end board 111 at one lateral side opposite to the ball return gutter 12. An unitary round rod 51 horizontally outwardly extends from the setback portion 50 for the mounting thereon of an elongated strip 52 permitting the elongated strip 52 to rotate thereon. The elongated strip 52 comprises an unitary pin 53 upstanding therefrom at one end and stopped against the bottom surface of the mounting slot 100 of the upper board 103 of the rear end board 111. The end of elongated strip 52 which is opposite to the unitary pin 53 is set to partly protrude in the notch 7 of the front end board 110. Therefore, when a ball is putted into the hole 10 by a putter or other golf club, it drops from the hole 10 of the upper board 103 of the rear end board 111 into the bevel groove 9 of the bottom board 104 to further run through the ball return gutter 12 to the ball chamber 101. If a ball does not enter the hole 10 during putting, it may be stopped by the side bumper 105 to stay in the rear end board 111. Under this condition, a golf club can be used to press in the notch 7 to turn the elongated strip 52 to rotate, so as to lift the upper board 103 of the rear end board 111 by means of the unitary pin 53. When the upper board 103 is lifted, the ball thereon will automatically roll down through the ball return gutter 12 to the ball chamber 101.

Referring to FIG. 2, the counting net unit 2 comprises two arms 21 and 22 bilaterally secured to two U-shaped holder plates 23 on the rear end board 111 by means of screws 24, which two arms 21 and 22 have each a retaining hole 25 for the insertion therein of an expansion rod 26 so that a net 27 can be mounted on the two expansion rods 26 of the two arms 21 and 23. The net 27 comprises several holes 28 having each a wire channel 29 extending backwardly to corresponding partition 31 in a nested holder 30. Each partition 31 of the nested holder 30 comprises therein an electrically contact end (not shown) similar to the structure of the buttons on an electronic calculator. When a ball is driven by an iron or other golf club to enter any of the holes 28 on the net 27, it is guided through a corresponding wire channel 29 into a corresponding partition 31 in the nested holder 30 to trigger the contact end therein, and the hole into which a ball is driven is identified through the display 6.

The nested holder 30 is comprised of a housing 301 having a stepped inner chamber for the setting therein of an intercrossed division frame assembly 302 in such a manner that any ball which is guided into either partition 31 in the nested holder 30 partitioned by the division frame assembly 302 is permitted to roll down through an opening 303 on the nested holder 30 at a lower position to a sliding way 304 which is communicated with the ball return gutter 12 and from which a ball can be guided to the ball chamber 101.

What is claimed is:

1. An indoor golf training course, including a teeing ground unit and a counting net unit, wherein said teeing ground unit is comprised of a plurality of flat boards including a front end board, a rear end board and a plurality of intermediate boards; said flat boards being covered with a layer of velvet or other surface layer and each having at least one T-shaped tenon and one T-shaped groove for connection with one another by means of tenon-and-groove to form a flat surface serving as a teeing ground; said intermediate boards and said rear end board each having a side groove aligned with one another in a line to form a ball return gutter; said front end board comprising a ball chamber on its one side adjacent to said intermediate boards, a recess hole on said ball chamber at a rear end for receiving a display, and a notch on its other side opposite to said ball chamber; said rear end board comprising an upper board laterally pivotably connected with a bottom board by means of a hinge joint; said upper board comprising a mounting slot at a side and a round hole in the center, said bottom board comprising a bevel groove extending laterally from its center point to communicate with the ball return gutter permitting any ball which enters said round hole of said upper board to run therethrough to said ball chamber via said ball return gutter; a setback portion being made on said intermediate boards and part of said rear end board at one lateral side opposite to said ball return gutter, said setback portion comprising a unitary round rod horizontally outwardly extending therefrom for the mounting thereon of an elongated strip permitting said elongated strip to rotate thereon, said elongated strip having its one end partly protruding in the notch of said front end board and comprising an unitary pin upstanding from its other end to stop against the bottom surface of said mounting slot of said upper board of said rear end board; characterized in that any ball which is putted into the hole of the upper board of said rear end board immediately drops to the bevel groove of the bottom board of said rear end board to further run through said ball return gutter to said ball chamber; any ball which does not enter the hole of the upper board of said rear end board can be guided to roll down through said ball return gutter to said ball chamber by using a golf club to press in the notch of said front end board to turn said elongated strip permitting the unitary pin of said elongated strip to lift the upper board of said rear end board.

2. An indoor golf training course as claimed in claim 1, wherein said counting net unit comprises two arms bilaterally secured to two U-shaped plates which are mounted on said rear end board and each having a retaining hole for the fastening therein of an expansion hole; and a net mounted on the two expansion rods of said two arms, said net comprising thereon several holes each having a wire channel extending backwardly to a corresponding partition in a nested holder.

3. An indoor golf training course as claimed in claim 1, wherein said nested holder is comprised of a housing having a stepped inner wall defining therein a wider upper space for the setting therein of an intercrossed division frame assembly and a narrower lower space, such that any ball which is guided therein is permitted to roll down through said lower space into an opening on said nested holder to a sliding way which communicates with said ball return gutter and from which a ball can be guided to said ball chamber.

* * * * *